US005588648A

United States Patent [19]

Stebbins

[11] Patent Number: 5,588,648

[45] Date of Patent: Dec. 31, 1996

[54] TRAINING BALL FOR BASEBALL AND SOFTBALL BATTING PRACTICE

[76] Inventor: Scott Stebbins, 8606 31st St. W., Tacoma, Wash. 98466

[21] Appl. No.: 445,795

[22] Filed: May 22, 1995

[51] Int. Cl.[6] ..... A63B 37/06

[52] U.S. Cl. ..... 473/451; 273/DIG. 20; 473/600; 473/613

[58] Field of Search ..... 273/60 R, 60 A, 273/60 B, 58 R, 58 A, 58 B, 58 BA, 58 H, 58 J, 58 K, 228, 230; 473/367, 368

[56] References Cited

U.S. PATENT DOCUMENTS

| | | | |
|---|---|---|---|
| 711,474 | 10/1902 | Chapman . | |
| 3,942,793 | 3/1976 | Lombardo | 273/60 R |
| 3,976,295 | 8/1976 | Heald, Jr. | 273/60 R |
| 4,149,720 | 4/1979 | Heald, Jr. | 273/60 R |
| 4,256,304 | 3/1981 | Smith et al. . | |
| 4,462,589 | 7/1984 | Morgan | 273/60 R |
| 4,538,817 | 9/1985 | Ramella . | |
| 4,738,450 | 4/1988 | Wexler . | |
| 4,763,900 | 8/1988 | Carr . | |
| 4,772,019 | 9/1988 | Morgan | 273/60 B |
| 4,840,378 | 6/1989 | Molitor | 273/60 B |
| 4,943,055 | 7/1990 | Corley | 273/60 R |
| 5,035,425 | 7/1991 | Edwards | 273/60 B |
| 5,158,284 | 10/1992 | Vogl | 273/60 B |

OTHER PUBLICATIONS

Memphis Press–Scimitar, Section D, "That's Incrediball—New Look Baseball becoming a smash hit", by Jack Brennan, May 28, 1982.

Contra Costa Times, p. 4C "That's Incrediball—New Baseball reduces threat of player injury" by Michael Torcellini, Apr. 30, 1982.

*Primary Examiner*—Steven B. Wong

*Attorney, Agent, or Firm*—Jeffrey J. King

[57] ABSTRACT

A weighted training ball for baseball and softball batting training which has a solid body of molded elastomeric material and a regulation circumference of between approximately 9–16 inches. The body is weighted to have a greater than regulation weight of between approximately 7.5–20 ounces. The body is also softer than regulation baseballs and softballs, with a type A-2 Shore durometer of between approximately 40–70.

18 Claims, 1 Drawing Sheet

TRAINING BALL FOR BASEBALL AND SOFTBALL BATTING PRACTICE

TECHNICAL FIELD

The invention relates to training balls for baseball and softball practice. More specifically, the invention relates to training balls for baseball and softball practice manufactured from elastomeric materials.

BACKGROUND OF THE INVENTION

In the sports of baseball and softball, it is important for players to maintain and improve their skills in a variety of activities, especially pitching and batting activities. To improve pitching and batting skills it is desirable for athletes to condition their muscles, as well as their mental processes, to achieve greater speed and distance when throwing or hitting the ball.

In baseball and softball, as well as in a variety of other sports, it is well known that physical and mental training can be enhanced through the use of a weighted training object. Thus, previous efforts to enhance the training of baseball and softball players have included the use of integrally weighted bats, such as the bat disclosed in U.S. Pat. No. 3,116,926 to Owen, for batting warm-up. Likewise, separate weights are also commonly used which can be attached to regulation bats to help a player increase his or her batting power.

In a variety of sports, including baseball and softball, weighted balls have also been developed, most commonly to achieve a further carry to the ball in flight. However, a number of weighted baseballs have also been developed for the purpose of athletic training. More specifically, U.S. Pat. No. 4,943,055 to Corley, and U.S. Pat. No. 3,942,793 to Lombardo, each disclose a weighted baseball and/or softball useful as a warmup device, particularly for pitchers. Both the Corley and Lombardo balls have a metallic, weighted core, as well as a cortex of dense packing or filling material and outer cover similar to the packing and cover of a regulation softball.

The weighted training balls of Corley and Lombardo are specifically designed for use in baseball pitching and throwing exercises, and are poorly adapted for use in baseball batting exercises. Only a slight amount of additional weight is recommended for pitching and throwing exercise, as excessive weight can cause over strengthening, loss of control and injury. Therefore, the weight which would have to be added to provide an effective training ball for batting exercises would be prohibitive of use for pitching training.

An additional drawback of the training balls described in the Corley and Lombardo patents is that the apparatus and materials required for the balls' construction are unduly expensive. The tri-layer design, including the metal core, filler and cover, imposes considerable costs over molded composite ball designs widely known in the art. One example of such a design is shown in U.S. Pat. No. 4,840,378 issued to Molitor, which describes a softball having a core of cellular polymeric material and a cover of vinyl resin. Similarly, U.S. Pat. No. 4,772,019 issued to Morgan describes baseballs and softballs made of a urethane foam core surrounded by a cloth cover. In a more simple and economic design, U.S. Pat. No. 4,256,304 issued to Smith discloses a homogenous polyurethane baseball manufactured in a single operation.

Yet another problem which attends the use of prior art, weighted baseballs and softballs is that such balls are poorly adapted for use in conventional pitching machines. Pitching machines, such as the "Coacting Wheel Ball Projecting Device" of U.S. Pat. No. 4,197,827, issued to Smith, are particularly useful in batting training, because they pitch a large number of balls rapidly and accurately, and can be employed for long periods, thereby avoiding several drawbacks present when a human training partner is used. However, the above described weighted balls and conventional baseballs are made of easily worn materials and suffer excessive wear and tear when used in pitching machines. Moreover, the surface irregularities caused by the stitching or artificial stitching of conventional and prior art weighted balls interfere with pitching accuracy of the machines, because the motive wheels which impel the balls catch unevenly on their irregular surfaces. For the same reason, most prior art balls tend to hang up in conveyor troughs of the machines due to the friction of their coverings and the presence of stitching.

In view of the above, there is a need in the baseball and softball industries for a weighted athletic training ball specifically designed for batting exercises.

A further need exists for a weighted batting training ball which has a simple construction and is easy and inexpensive to manufacture.

Yet another need exists for a weighted batting training ball which is durable and non orientation sensitive for accurate use in conjunction with conventional pitching machines.

SUMMARY OF THE INVENTION

It is therefore an object of the present invention to provide a weighted athletic training ball which is specially adapted for batting exercises, has a sufficiently weighted body to be useful for physical and mental conditioning of batters.

It is another object of the invention to provide the above weighted batting training ball in a design which is simply constructed and easy and inexpensive to manufacture.

It is yet another object of the invention to satisfy the above objects in a weighted batting training ball which is durably made and which is not orientation sensitive when pitched by a conventional pitching machine.

The invention satisfies these objects and other objects and advantages by providing a weighted training ball for baseball and softball batting training which has a substantially spherical, solid body made of a molded elastomer. The body has a regulation baseball or softball circumference between about 9–16 inches, and a weight of between approximately 7.5–20 ounces. The ball has an average density of the body between approximately 0.0072–0.0609 lbs/cu in., and a type A-2 Shore durometer at a surface of the body of between approximately 40–70.

In a preferred embodiment, the training ball has a type A-2 Shore durometer at the surface of the body between 40–60.

Also in a preferred embodiment, the body of the training ball is made of a homogeneous elastomeric material, so that the body has a constant density and durometer throughout.

In a more specific embodiment, the body is sized approximately the same as a regulation baseball, with a circumference of about 9 inches, at which size a preferred weight for batting training is between about 7.5–10 ounces. In an alternate embodiment the body is sized approximately the same as a small or large regulation softball having a regulation softball circumference of between approximately 11–16 inches; within which size range a preferred weight range for batting training is between about 8–20 ounces.

More specifically, a selected weight of the ball preferably is roughly proportional to a selected size of the ball, within the above described size and weight ranges. For example, one softball embodiment features a body circumference of approximately 12 inches, and a weight of between approximately 8–12 ounces.

In an alternate embodiment of the invention, a weighted training ball is provided which includes a recessed channel on the surface of the body for better aerodynamic performance of the ball, and to render the ball non orientation sensitive when used in a conventional pitching machine. Preferably, the channel is a continuous channel, patterned to resemble a pattern of stitching on a regulation baseball.

Although the training ball of the invention is preferably of a unitary, homogeneous construction, alternate embodiments of the invention are provided which include a cover encasing the body made of different material than the molded elastomeric material of the body. The cover so provided can be made of a variety of suitable materials, including cloth, leather and vinyl.

Other embodiments of the invention are provided which have specific rebound characteristics to enhance batting training capabilities. Specifically, it is preferred to construct the body from suitable materials; or at least with suitable surface characteristics, so that the ball has a relatively high rebound percentage, in the range of approximately 35–50%.

DETAILED DESCRIPTION OF THE INVENTION

Figure 1:
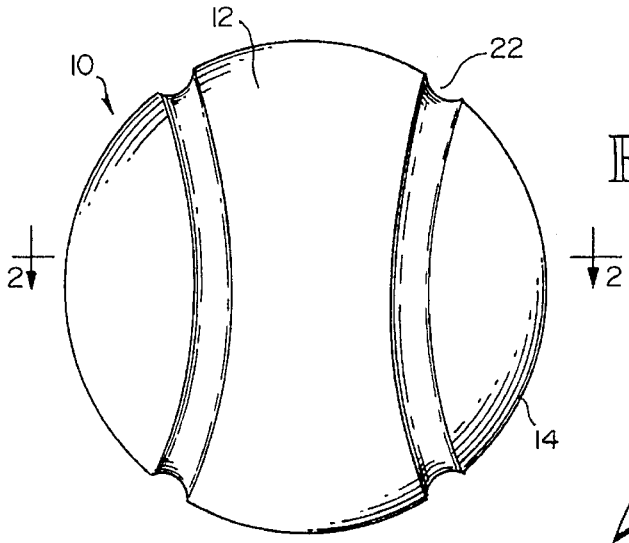
FIG. 1 is a top plan view of a weighted training ball employing the concepts of the present invention.

A weighted training ball employing the concepts of the present invention is generally depicted at reference numeral 10 in FIG. 1. The ball has a substantially spherical, solid body 12 made partially or entirely of a molded elastomeric material. The body has a regulation baseball or softball circumference between about 9–16 inches, and a weight of between approximately 7.5–20 ounces. The ball has an average body density of between approximately 0.0072–0.0609 lbs/cu in., and the body has a type A-2 Shore durometer in at least a portion of the body underlying a body surface 14 of between approximately 40–70.

Before a further detailed description of the invention is presented, it should be understood that a key inventive concept of the training ball 10 is its unique combination of a greater than regulation ball weight, sufficient for batting practice, and a lower than regulation durometer. Previously known weighted balls are strictly designed for pitching and throwing practice, and are insufficiently weighted for batting practice. Moreover, both conventional baseballs and softballs, as well as previously known weighted balls, are all made of relatively high durometer materials. Based on experiments conducted for designing the present training ball, it has been determined that these high durometer (i.e. above approximately 70 Shore A hardness) materials cannot be effectively used for manufacturing a batting training ball. If a ball made of such high durometer material were sufficiently weighted for use in batting practice, the ball would impose significant risks in terms of potential equipment damage and personal injuries. In testing such high durometer balls, it has been shown that batters can damage aluminum and composite bats when hitting the balls, even when only moderately increased ball weight and batting power is employed. It is clear that heavier balls and more powerful hitting exercises, desired for effective batting practice, impose a significant risk of equipment injury when standard durometer construction materials are used. A parallel set of risks are apparent in the case of potential personal injuries, such that it would not be judicious to employ a regulation durometer ball sufficiently weighted for batting practice.

A primary goal of the weighted training ball 10 of the invention is to increase pitched side momentum of the ball to acclimate a batting practitioner to instinctively exert more force and "bat through the pitch," when batting a regulation weight ball. By increasing the pitched side momentum, the batting practitioner becomes physically and psychologically conditioned so that he or she hits the seemingly light, regulation ball farther and faster. Not only does the batter's hitting power increase, but his or her grip is also strengthened by the use of the weighted training ball. The increased pitched side momentum tends to cause deflection of a weakly gripped bat, thereby conditioning the batter to grip the bat more firmly. The same principal further conditions the batting practitioner to avoid hitting pop-ups and foul balls.

The low durometer, heavily weighted combination provided by the training ball 10 of the invention further minimizes risks of equipment damage and personal injury when the ball is used in a conventional pitching machine. An ancillary benefit of increasing the pitched side momentum of the ball is that the speed of the ball being pitched can be reduced relative to a speed required for an unweighted ball, and yet the weighted ball can still provide greater momentum on the pitched side. In conventional batting practice using pitching machines, practitioners are automatically served pitches from about 60 mph, up to more than 90 mph. Even though pitching machines are fairly accurate, these high pitching speeds still impose a substantial risk that an inattentive batter, or a batter exposed to a "wild" pitch, may be struck and potentially seriously injured by the ball. By increasing the momentum of the ball, the pitch speed can be reduced to a safer level, while the batter still receives a more rigorous training experience than would be provided by machine pitched, regulation balls. In this same context, the relatively low durometer of the training ball of the invention compared to regulation balls further reduces the risk of equipment and personal injury in machine pitched training exercises, because the softer ball will cause less impact damage than a higher durometer ball at equal weights and speeds.

Figure 2:
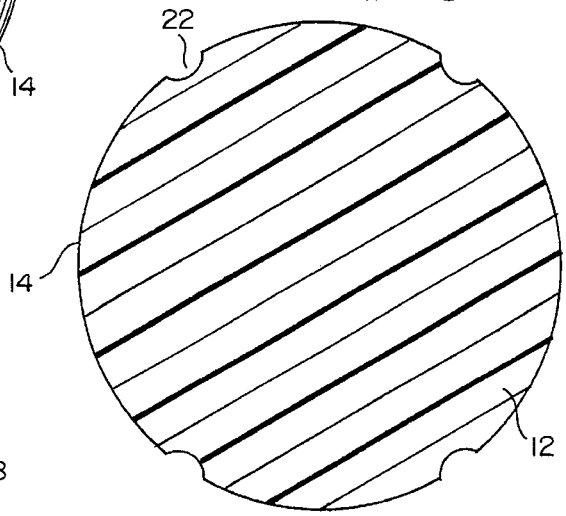
FIG. 2 is a sectional, isometric view of the training ball of the invention, taken along lines 2—2 of FIG. 1.

Referring now to FIG. 2 of the drawings, a preferred embodiment of the training ball 10 is provided which has a body 12 made of a homogeneous elastomeric material, so that the body has a constant density and durometer throughout. Preferably, the homogeneous body has a type A-2 Shore durometer between 40–60. It is also preferred that the training ball have a "lively" action or high energy return to enhance the ball's intrinsic batting training capabilities. Specifically, it is preferred to construct the body from suitable materials, or at least with suitable surface characteristics, so that the ball has a relatively high rebound percentage, preferably in the range of approximately 35–50% when the ball is dropped from a height of about 15 feet onto a concrete surface.

Figure 3:
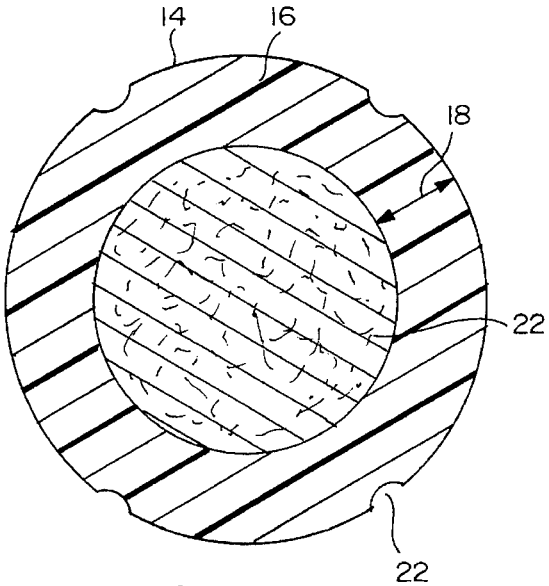
FIG. 3 is a sectional, isometric view of an alternate embodiment of the invention illustrating a core and cortex of a body of the training ball.

Although a homogeneous construction of the body 12 is particularly preferred, it is also contemplated to provide a weighted training ball which possesses the desired low durometer only at a subsurface portion, or cortex 16 of the body (see FIG. 3). In this context, it is apparent that the entire body need not be constructed of low durometer material to avoid equipment and personal injury damages attributable to high durometer, weighted balls. Rather, by providing a low durometer cortex, having a thickness 18 of approximately ¼ inch to 2½ inches in an appropriately weighted ball for batting practice, the risks attending the use of high durometer, weighted balls can be substantially reduced. For a regulation sized baseball of about 9 inches circumference, a core thickness of about ¼ to 1½ inches is satisfactory. If such a buffering cortex is provided underlying the surface 14 of the body, then a central, or core 20 portion of the body can be made of a higher durometer material, eg. a harder elastomer or a conventional filler as provided in regulation baseballs, without significantly compromising the safety and action characteristics of the ball.

With regard to the size of the training ball, specific embodiments are provided which approximate sizes of regulation baseballs and softballs, and which are weighted proportionally to ball size. In one such embodiment, the body 12 is sized approximately the same as a regulation baseball, with a circumference of about 9 inches, at which size a preferred weight for batting training has been found to be in the range of about 7.5–10 ounces, more preferably about 8 ounces. In an alternate embodiment the body is sized approximately the same as small or large regulation softballs, which have regulation circumferences of about 11, 12, 14 or 16 inches. Within this size range, an appropriate range of weights is between about 8–20 ounces. A preferred weight within a selected weight range is chosen to be proportional to a chosen size within a selected size range. Accordingly, a preferred softball embodiment features a body circumference of approximately 12 inches, and a weight of between approximately 8–12 ounces, more preferably about 10 ounces. Larger softballs will be roughly proportionally weighted more heavily. It is also contemplated that for a specific size of ball, a set of balls having successively higher weights may be provided, to enable players of different levels of skill to train with a single set of balls, and to allow individual players to gradually improve their skills by progressively selecting heavier balls during a progressive training program.

Referring to FIGS. 1–3, the weighted training ball 10 is preferably provided with one or more recessed channels 22 on the surface of the body 12 for better aerodynamic performance of the ball. The channels disrupt laminar air flow of the pitched ball, creating turbulent air flow which stabilizes the flight path of the ball. The channels also eliminate the problem of orientation sensitivity which results when seamed balls are used in a conventional pitching machine. Preferably, the channel is a single, continuous channel patterned to resemble a pattern of stitching on a regulation baseball. This creates a familiar grip pattern for fingers of a pitcher to grip the ball, as well as a familiar, visible rotation pattern of the ball in flight.

Figure 4:
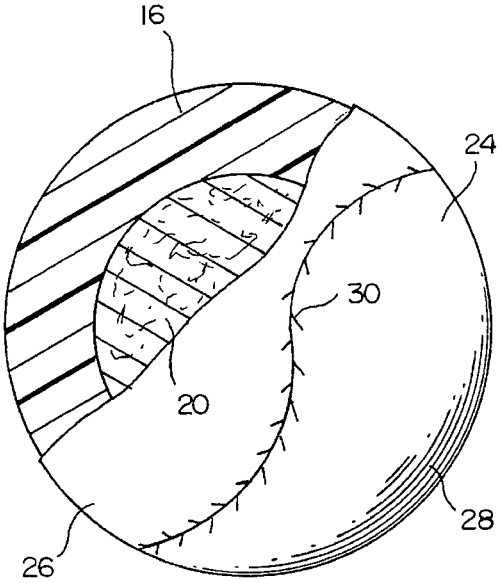
FIG. 4 is a sectional, isometric view of an alternate embodiment of the invention illustrating a core and cortex of the body, and a cover encasing the body of the training ball.

As noted above, the training ball 10 of the invention is preferably of a unitary, homogeneous construction. More preferably, the training ball is made of a homogenous elastomer, which is preferably self-skinning at the surface 14 of the body 12 to reduce water absorption. However, as shown in FIG. 4, alternate embodiments of the invention are provided which include a cover 24 encasing the body which is made of a different material than the molded elastomeric material of the body. The cover can be made of a variety of suitable materials, including cloth, leather and vinyl, among others. Preferably, the cover resembles the covers of regulation baseballs, being made of two pieces 26, 28 of leather stitched together in a pattern similar to standard baseball stitching 30. The covered body can be otherwise homogeneously constructed, or may be made with a low durometer cortex 16 and a low, medium or high durometer core 20, as shown in FIG. 4.

The weighted training ball 10 of the invention is preferably made using a conventional injection/extrusion blow molding process, however a variety of other manufacturing processes can be used. A preferred elastomer for manufacturing the training ball has been found to be a low durometer, urethane elastomer, such as the Conathane® TU4010, Conathane® TU601 and Conathane® TU4060 elastomers provided by Conap, Inc., Olean, N.Y. Preferred characteristics of these elastomers are their low durometers; 40, 60 and 60 for Conathane® TU4010, Conathane® TU601 and Conathane® TU4060, respectively, combined with their suitable densities, 0.0505, 0.0375 and 0.05885 lbs/cu in., respectively for manufacturing balls appropriately weighted in proportion to their circumference. In this context, a preferred density of the elastomer is in the range of 0.009–0.0609 lbs/cu in., more preferably in the range of 0.0215–0.05885 lbs/cu in. The Conathane® elastomers also satisfy preferred water absorption characteristics for the invention, which should be low in order that the already weighted balls do not pick up excess moisture and weight when played on wet fields. Specifically, both the Conathane® TU4010 and Conathane® TU4060 exhibit satisfactory water absorption in samples cured for 7 days at 25° C. of less than approximately 2% after two days. In addition to these characteristics, Conathane® TU4010 and Conathane® elastomers produce a weighted training ball with a rebound percentage when dropped from 20 feet onto a concrete surface in the preferred range of approximately 35–50%. While these specific elastomers have been found to satisfy preferred parameters of the invention, other urethane and non-urethane elastomers can be readily obtained or engineered using conventional techniques to satisfy the needs of the invention.

Those with ordinary skill in the art will appreciate that other embodiments and variations of the invention are possible which employ the same inventive concepts described above. Therefore, the invention is not to be limited by the above disclosure but is to be determined in scope by the claims which follow.

I claim:

1. A weighted training ball for baseball batting training, comprising:

a substantially spherical, solid body of molded elastomeric material, wherein the body has a circumference of approximately 9 inches, a weight of between approximately 7.5–10 ounces, an average density of the elastomeric material forming the body of between approximately 0.0214–0.05885 pounds per cubic inch, and a type A-2 Shore durometer at a surface of the body of between approximately 40–70.

2. A weighted training ball according to claim 1, wherein the elastomeric material is a polyurethane, and wherein the durometer at the surface of the body is between 40–60.

3. A weighted training ball according to claim 1, wherein the body is made of a homogeneous elastomeric material, the body thereby having a constant density and durometer throughout.

4. A weighted training ball according to claim 1, wherein the body has a cortex of a low durometer elastomeric material having a hardness in the range of between 40–60 Shore A durometer, and a core having a core durometer different than the durometer of the cortex.

5. A weighted training ball according to claim 1, wherein the surface of the body has a recessed channel for better aerodynamic performance of the ball, and to render the ball non orientation sensitive when used in a pitching machine.

6. A weighted training ball according to claim 5, wherein the recessed channel is a continuous channel patterned to resemble a pattern of stitching on a standard baseball.

7. A weighted training ball according to claim 1, wherein the body is encased in a cover of material having a different composition from the molded elastomeric material making up the body.

8. A weighted training ball according to claim 7, wherein the cover is made of a material selected from the group consisting of cloth, leather and vinyl.

9. A weighted training ball according to claim 1, wherein the body has a rebound percentage from about 15 feet onto a concrete surface in the range of approximately 35–50%.

10. A weighted training ball according to claim 1, wherein the elastomeric material has a water absorption in samples cured for 7 days at 25° C. less than approximately 2% after two days.

11. A weighted training ball according to claim 1, wherein the elastomeric material is a polyurethane having a density of approximately 0.0505 and a type A-2 Shore durometer of approximately 40.

12. A weighted training ball according to claim 1, wherein the elastomeric material is a polyurethane having a density of approximately 0.0588 and a type A-2 Shore durometer of approximately 60.

13. A weighted training ball for softball batting training, comprising:

a substantially spherical, solid body of molded elastomeric material, wherein the body has a circumference of approximately 11 inches, a weight of between 8–20 ounces, and a type A-2 Shore durometer at a surface of the body of between approximately 40–70.

14. A weighted training ball for softball batting training, comprising:

a substantially spherical, solid body of molded elastomeric material, wherein the body has a circumference of approximately 12 inches, a weight of between 10–20 ounces, and a type A-2 Shore durometer at a surface of the body of between approximately 40–70.

15. A weighted training ball for softball batting training, comprising:

a substantially spherical, solid body of molded elastomeric material, wherein the body has a type A-2 Shore durometer at a surface of the body of between approximately 40–70, a size range of between 11–16 inches circumference, and a weight range of between 8–20 ounces, and wherein a selected weight of the ball is roughly proportional to a selected size of the ball within said size and weight ranges so that an 11 inch ball has a selected weight of at least 8 ounces and a 16 inch ball has a selected weight of approximately 20 ounces.

16. A weighted training ball according to claim 15, wherein the elastomeric material is a polyurethane, and wherein the durometer at the surface of the body is between 40–60.

17. A weighted training ball according to claim 15, wherein the body has a cortex of a low durometer elastomeric material having a hardness in the range of between 40–60 Shore A durometer, and a core having a core durometer different than the durometer of the cortex.

18. A weighted training ball according to claim 15, wherein the body is encased in a cover of material having a different composition from the molded elastomeric material making up the body.

* * * * *